US007830314B2

(12) United States Patent
McGuire et al.

(10) Patent No.: US 7,830,314 B2
(45) Date of Patent: Nov. 9, 2010

(54) ADJUSTABLE INDUSTRIAL ANTENNA MOUNT

(75) Inventors: Chad M. McGuire, Minneapolis, MN (US); Joel D. Vanderaa, St. Paul, MN (US)

(73) Assignee: Rosemount Inc., Eden Prairie, MN (US)

( * ) Notice: Subject to any disclaimer, the term of this patent is extended or adjusted under 35 U.S.C. 154(b) by 933 days.

(21) Appl. No.: 11/708,292

(22) Filed: Feb. 20, 2007

(65) Prior Publication Data

US 2007/0198224 A1 Aug. 23, 2007

Related U.S. Application Data

(60) Provisional application No. 60/775,377, filed on Feb. 21, 2006.

(51) Int. Cl.
*H01Q 1/24* (2006.01)

(52) U.S. Cl. ..... 343/702; 343/878; 343/906

(58) Field of Classification Search ..... 343/702, 343/878, 882, 906

See application file for complete search history.

(56) References Cited

U.S. PATENT DOCUMENTS

| | | | | |
|---|---|---|---|---|
| 5,440,315 | A | 8/1995 | Wright et al. | 343/702 |
| 5,734,716 | A | 3/1998 | Kulberg | 379/433 |
| 5,805,115 | A | 9/1998 | Pellerin et al. | 343/763 |
| 5,949,379 | A | 9/1999 | Yang | 343/702 |
| 6,518,928 | B1 * | 2/2003 | Sheu | 343/702 |
| 6,710,747 | B1 * | 3/2004 | Chang | 343/702 |
| 7,190,053 | B2 | 3/2007 | Orth et al. | 257/659 |
| 7,400,301 | B2 * | 7/2008 | Chan | 343/702 |
| 7,471,933 | B2 * | 12/2008 | Lin | 455/97 |
| 2006/0284771 | A1 * | 12/2006 | Liang et al. | 343/702 |

OTHER PUBLICATIONS

Communication for related European patent Application No. 07751135.0-0220 mailed Dec. 29, 2009; 4 pages.

"Notification of Receipt of Search Copy", PCT/US2007/004353, filed Feb. 20, 2007, 3 pages.

"Invitation to Pay Additional Fees and Communication Relating to the Results of the Partial International Search", PCT/US2007/004353, filed Feb. 20, 2007.

International Search Report and Written Opinion to International Application No. PCT/US2007/004353 filed Feb. 20, 2007; mailed Sep. 27, 2007.

* cited by examiner

*Primary Examiner*—Tan Ho
(74) *Attorney, Agent, or Firm*—Westman, Champlin & Kelly, P.A.

(57) ABSTRACT

A field device including a housing having an outer surface and an inner surface surrounding a main cavity. The housing further includes an aperture extending from the main cavity to the outer surface. An electrical component is located within the main cavity of the housing. An antenna is in electrical communication with the electrical component. The field device further includes a rotatable mount attached to the housing. The mount has a channel extending from a first end to a second end of the mount. A cable is electrically connected to the electrical component and the antenna and the cable extends through at least a portion of the channel.

17 Claims, 10 Drawing Sheets

ADJUSTABLE INDUSTRIAL ANTENNA MOUNT

CROSS REFERENCE TO CO-PENDING APPLICATION

This application claims priority benefits from U.S. provisional patent application Ser. No. 60/775,377, filed Feb. 21, 2006, and entitled "ADJUSTABLE INDUSTRIAL ANTENNA MOUNT WITH EMI SHIELDING AND ENVIRONMENTAL PROTECTION".

BACKGROUND

The present discussion relates to industrial process control monitoring devices. More particularly, the present discussion relates to field devices configured to communicate wirelessly with remote devices in process control systems that are adapted for use in harsh environmental conditions.

Electronic field devices (such as process transmitters) can be used to monitor the operation of industrial processes such as those in oil refineries, chemical processing plants, paper processing plants, biotechnology plants, pharmaceutical plants, food and beverage plants, and the like. Process transmitters for monitoring an industrial process may be used to measure one or more phenomena that are related to or capable of impacting the process. Some phenomena that may be measured in industrial processes include pressure, flow rate, fluid or material level in a tank, temperature, and vibration. Additionally, such field devices may include electronics capable of performing analysis of measured data related to one or more phenomena, diagnostic electronics, or other process monitoring electronic devices, or even electronic, hydraulic, or pneumatic actuator devices used for industrial process control.

Field devices can also include circuitry for communicating over a process control loop with other monitoring or control devices such as, for example, other installed field devices, hand held tools, or equipment that may be remotely located, for example, in a process control room. Data transmitted over the process control loop can be transmitted in either an analog or a digital format. Analog field devices are often connected to other devices via two-wire process control current loops. For example, a number of field devices can be connected to a process control room via a single two-wire control loop.

In addition or alternatively, field devices can have wireless communication technologies incorporated to facilitate communication with other remotely located monitoring and control devices. Wireless communication technologies provide the advantage of simplifying field device implementation because field devices that do not rely on wired communication need not have any wires provided to them. For certain types of wireless communication, an antenna is attached to the field device and is in electrical communication with wireless communication circuitry located with the field device to boost the transmitted signals.

Field devices, including process transmitters, can be routinely located in relatively harsh environments. Such environments may be potentially deleterious to, for example, electrical components and/or electrical connectors of the field device, including connections for two wire communication loops and/or antennas. For example, process transmitters can potentially be installed in locations where they are exposed to liquids, dust and humidity and various industrial contaminants. Some of these field devices may be exposed to potentially corrosive process liquids, such as acid or base solutions, that are a part of the particular industrial process. Such liquids may drip, splash, or be sprayed onto the field. In addition, field devices may be exposed to other materials, such as cleaning agents. In addition, field devices may be exposed to electromagnetic waves that can potentially interfere with the operation of electrical components within the field device, including the process transmitter and wireless communication devices. Furthermore, field devices can be located in external environments, where they can be exposed to, for example, temperature extremes, vibration, precipitation, ultra-violet light, and wind.

In view of the harsh environments in which field devices are installed and in view of the need to provide a wireless signal to remote devices in such environments, there is an ongoing need in the art for industrial process transmitter housing configurations. Such housing configurations require improved robustness with respect to harsh environmental conditions, including exposure to dust, liquids, humidity, and electromagnetic energy. In addition, such devices require an ability to communicate properly with other wireless devices.

SUMMARY

The discussion is directed towards devices and methods for providing wireless communication in an industrial process control system. More particularly, the discussion is directed toward systems and methods for employing a rotatable antenna mount with such a device.

In one embodiment, a field device is discussed. The field device includes a housing having an outer surface, an inner surface surrounding a main cavity, and an aperture extending from the main cavity to the outer surface. An electrical component is located within the main cavity of the housing. An antenna is in electrical communication with the component. The field device further includes a rotatable mount that is attached to the housing. The rotatable mount has a channel that extends from a first end to a second end. A cable is electrically connected to the electrical component and the antenna. The cable extends through at least a portion of the channel.

In another embodiment, an antenna mount for a field hardened industrial device is discussed. The antenna mount includes a first portion having an outer surface and an inner surface defining a first cavity that extends from a first end to an aperture at the outer surface of a second end. The antenna mount further includes a second portion having an outer surface and an inner surface defining a second cavity that extends from a first end to an aperture at the outer surface of a second end. The first and second portions are attached to each other along a generally planar attachment surface at their first ends. The attachment surface is not perpendicular to the any of the outer surface at the second ends of the first and second portions.

In yet another embodiment, a method of attaching an antenna to a field hardened industrial device is discussed. The method includes attaching a rotatable mount to a housing of the field hardened industrial device. The method further includes providing an electrical connection between an antenna to an electrical component located within the housing. The mount is rotated relative to the housing to adjust the position of the antenna.

While the above-identified illustrations set forth embodiments of the present invention, other embodiments are also contemplated, some of which are noted in the discussion. In all cases, this disclosure presents the illustrated embodiments by way of representation and not limitation.

DETAILED DESCRIPTION

The present discussion is directed to a field hardened industrial device, such as a process transmitter. As used herein, the phrase "field hardened industrial device" or, alternatively, "field device" refers to a device with a housing for use in harsh environmental conditions including outdoor applications. The housing of the field hardened industrial device of the current discussion is sealed to protect the contents against environmental contamination. In addition, the housing is designed to be resistant to electromagnetic and/or radio frequency interference that might otherwise be induced or conducted onto electrical devices or circuitry contained within it.

Field hardened industrial devices of the type to which the current discussion is directed are capable of wireless communication with a remote device. A remote device can be any device outside of the particular field hardened industrial device in question. For example, the remote device can be a handheld device, another field hardened industrial device in the same environment such as the same process room or general area, or a device located outside of the same environment such as, for example, a device in a control room.

Figure 1:
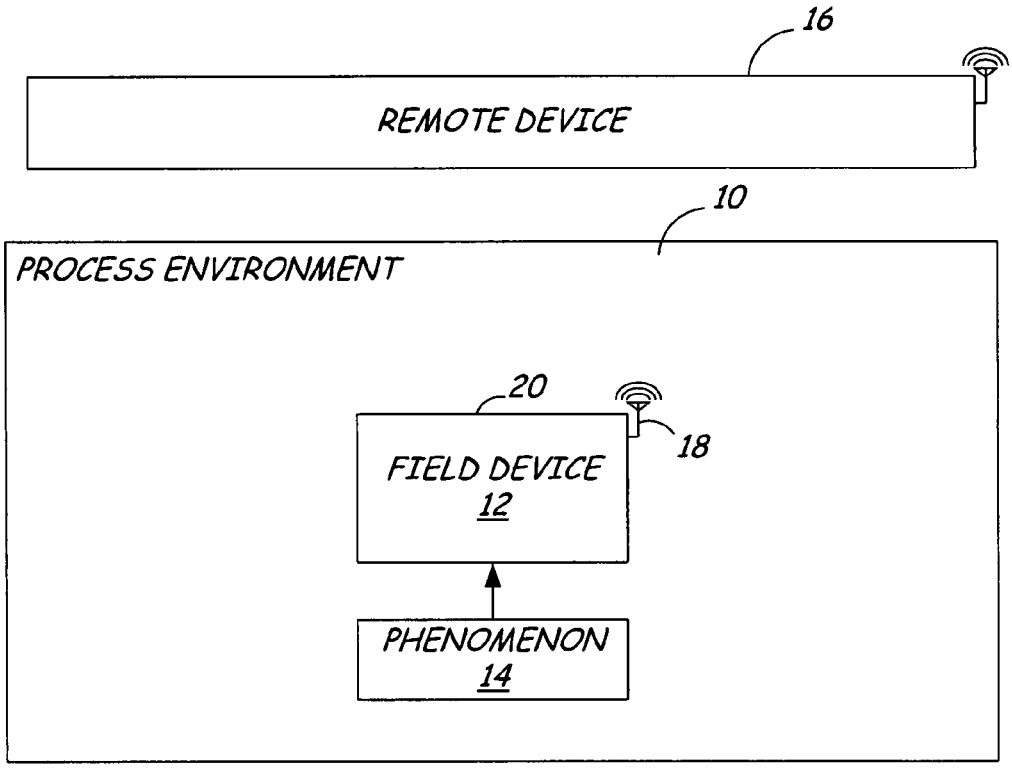
FIG. 1 is a block diagram of a process environment illustrating a field hardened industrial device with which an adjustable industrial antenna mount in accordance with the present disclosure is particularly useful.

FIG. 1 is a block diagram that illustrates a process environment 10 in which a field hardened industrial device 12 is illustratively employed. Process environment 10 can be one of any number of industrial environments, including, for example, manufacturing, refining, or many other applications in which it is advantageous to monitor one or more phenomena and/or control a particular process. The field hardened industrial device 12, in one illustrative embodiment, is capable of sensing one or more process phenomena 14 to which it is exposed and providing a signal indicative of a status of the given process phenomenon. Examples of the types of phenomena 14 to which the field hardened industrial device 12 may be exposed include temperature, pressure, fluid flow, pH levels, etc. Alternatively, field hardened industrial device 12 may be exposed to and be configured to measure a plurality of phenomena 14. Alternately, or in addition, the field hardened industrial device 12 may include an actuation device, which can control a process or a portion of a process.

Field hardened industrial device 12 illustratively includes a housing 20 in which a transducer (26 shown in FIG. 2) is enclosed. The transducer 26 is capable of providing a signal indicative of phenomenon 14 to which it is exposed. Field hardened industrial device 12 also illustratively includes an antenna 18, which is coupled to housing 20. The antenna 18 is in electrical communication with the remote electrical device 16 and can send and receive signals transmitted between the electrical component 16 of field hardened industrial device 12 and a remote electrical device 16.

Figure 2:
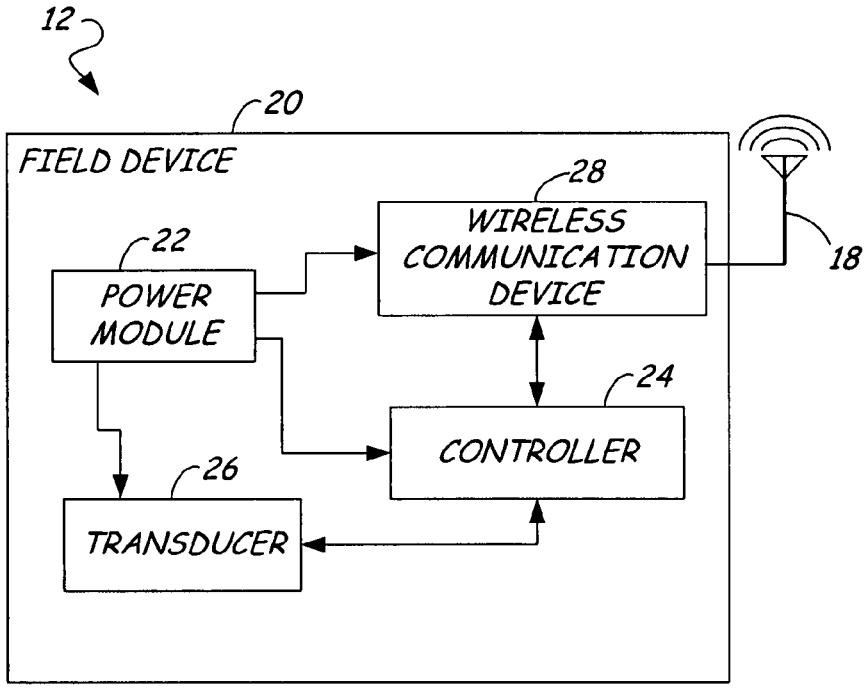
FIG. 2 is a block diagram of the field device of FIG. 1, illustrating an electrical circuit coupled to an antenna at a rotatable mount according to one illustrative embodiment.

FIG. 2 is a functional block diagram illustrating field device 12 in more detail according to one illustrative embodiment. Field device 12 includes a power module 22 for supplying power to the other components within the field device 12. Power module 22 can utilize any acceptable technology to provide appropriate electrical signal levels to various devices within the field device 12. For example, power module 22 can employ known thermopile devices to generate electricity from disparate temperatures using the Peltier Effect, including, but not limited to thermoelectric diodes; solid state thermogenerators; and semiconductor thermoelectric generators. Alternatively, power module 22 can include a solar cell. Other types of power modules can be used such as, for example, batteries. For example, in lieu of an onboard power module 22, an external power supply (not shown) can provide a power signal to the field device 12.

Field device 12 also illustratively includes a controller 24, and a wireless communication device 28 located within housing 20 along with transducer 26. Power module 22 illustratively provides power to each of the controller 24, transducer 26 and wireless communication device 28. As discussed above, transducer 26 is, in one embodiment, configured to measure a phenomenon to which it is exposed. Alternatively, transducer 26 can generate an output signal to control an external component (not shown). Controller 24 is in communication with the transducer 26 to send and/or receive signals to or from the transducer 26. Controller 24 also provides signals to the wireless communication device 28, which in turn is capable of communicating information with remote devices.

Wireless communication device 28 can communicate process-related information as well as device-related information. Depending upon the application, wireless communication device 28 may be adapted to communicate in accordance with any suitable wireless communication protocol including, but not limited to: wireless networking technologies (such as IEEE 802.11b wireless access points and wireless networking devices built by Linksys of Irvine, Calif.), cellular or digital networking technologies (such as Microburst® by Aeris Communications Inc. of San Jose, Calif.), ultra wide band, free space optics, Global System for Mobile Communications (GSM), General Packet Radio Service (GPRS), Code Division Multiple Access (CDMA), spread spectrum technology, infrared communications techniques, SMS (Short Messaging Service/text messaging), or any other suitable wireless technology. Further, known data collision technology can be employed such that multiple units can coexist within wireless operating rage of one another. Such collision prevention can include using a number of different radio-frequency channels and/or spread spectrum techniques.

Wireless communication device 28 can also include transducers for a plurality of wireless communication methods. For example, primary wireless communication could be performed using relatively long distance communication methods, such as GSM or GPRS, while a secondary, or additional, communication method could be provided for technicians or operators near the unit, using for example, IEEE 802.11b or Bluetooth.

Some wireless communications modules may include circuitry that can interact with the Global Positioning System (GPS). GPS can be advantageously employed in field device 12 for mobile devices to allow finding the individual field device 12 in a remote location. However, location sensing based upon other techniques can be used as well.

Field device 12 illustratively includes capability for wireless communication. Additionally, field device 12 can, but need not, include the capability to communicate via a wired communication protocol with other remote devices such as other field devices, displays, and other monitoring or control devices. Wired communication can be advantageous if the field device 12 is required to communicate with other devices that do not have wireless communication capability. To that end, field device 12 can be equipped to communicate, for example, with devices over a two-wire process loop (not shown). Examples of process control loops that might be incorporated include analog 4-20 mA communication, hybrid protocols which include both analog and digital communication such as the Highway Addressable Remote Transducer (HART®) standard, as well as all-digital protocols such as the FOUNDATION™ Fieldbus standard.

Figure 3:
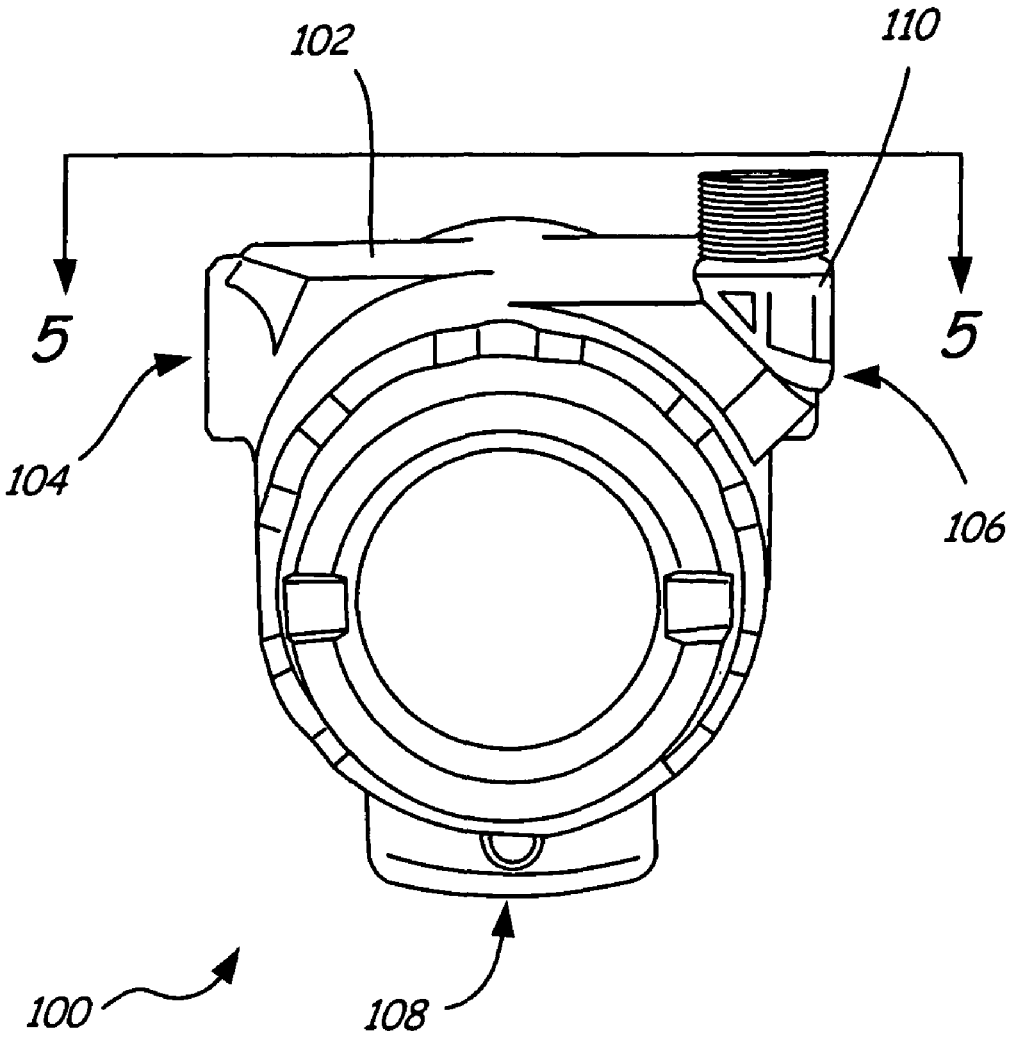
FIG. 3 is a schematic diagram of the field device of FIG. 1, illustrating an industrial antenna mount according to one illustrative embodiment.

FIG. 3 illustrates a portion of a field hardened industrial device 100 of the type described above according to one illustrative embodiment. Field device 100 includes a housing 102, which provides an enclosure for components such as the electrical devices discussed above. Housing 102, in one embodiment, is formed from a high strength material such as stainless steel, aluminum, or other acceptable material. The housing 102 can be attached to one or more sensing devices (not shown), which are intended to be exposed to, for example, liquids, gases or other materials for the purpose of measuring a particular phenomenon. Each sensing device illustratively provides a signal to electrical components within the housing 102. Such electrical components are illustratively adapted to determine a measurement based upon signals provided by the sensing device.

Alternatively or in addition, an actuation device (not shown) can be attached to the housing 102 and be in electrical communication with electrical components located within the housing 102. The electrical components within the housing 102 can illustratively provide a signal to control the actuation device, which in turn can control an aspect of a particular process. It should be appreciated that a single device attached the housing 102 can provide both a sensing and an actuation function without departing from the scope of the discussion.

The representative housing illustrated in FIG. 3 includes three ports 104, 106, and 108 to which the sensing and/or actuation device may be attached. Housing 102 can thus be illustratively connected to the sensing and/or actuation device in a number of different orientations. Ports 104, 106 and 108 are shown and detailed in part to show the orientation of the housing 102 in different FIGs. that are a part of the current discussion. Any configuration of ports can be employed in housing 102 and this discussion is not intended to limit the arrangement of ports in the housing 102 of field device 100 in any way. In addition, the field device 100 has a rotatable antenna mount 110 attached to the housing 102. Further, it should be appreciated that although FIG. 3 illustrates a housing 102 that is configured to be attached to one or more sensing and/or actuation devices, housing 102 can include a sensing and/or actuation device located within it without departing from the scope of the discussion.

Figure 4:
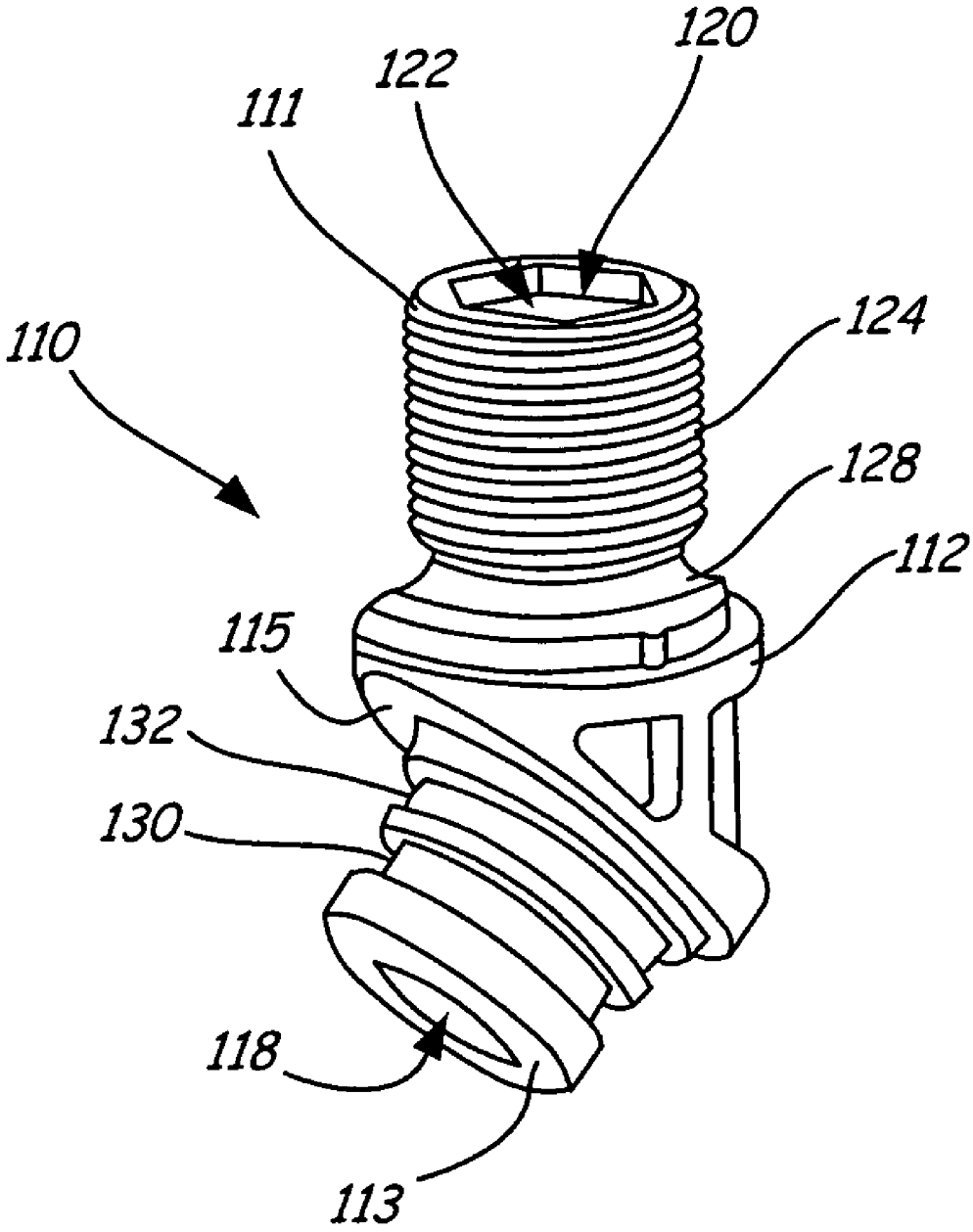
FIG. 4 is a perspective view of the industrial antenna mount of FIG. 3.

FIG. 4 shows a perspective view of the rotatable mount 110 according to one illustrative embodiment. The rotatable mount 110 includes a body 112, which, in one illustrative embodiment, is formed from a polymeric material, although other suitable materials may be used including conductive materials such as, for example, aluminum. The body 112 illustratively includes an upper portion 111 and a lower portion 113. The upper portion 111 and the lower portion 113 are, in one illustrative embodiment connected or attached to each other along an angled attachment surface 115. While the upper portion 111 and the lower portion 113 are described as being connected or attached to each other, it should be appreciated that the upper and lower portions 111 and 113 can be formed from a single, integral piece of material. The upper and lower portions 111 and 113 are illustratively connected to each other along one of each of their ends. The angled surface 115 is angled with respect to the general orientation of each of the upper and lower portions 111 and 113. In one illustrative embodiment, the upper and lower portions 111 and 113 extend from the angled surface 115 at about a 45-degree angle with respect to each other.

The body 112 includes a channel 120 that extends from an aperture 122 on the upper portion 111 to an aperture 118 on the lower portion 113. Because the upper portion 111 and the lower portion 113 are shown as being angled with respect to each other, channel 120 is illustratively an angular path from the aperture 118 to the aperture 122. Rotatable mount 110 illustratively includes a pair of grooves 130 and 132 that extend around a perimeter of the lower portion 113 of the body 112. Grooves 130 and 132 are each configured to accept a sealing device, which will be discussed in more detail below.

Rotatable mount 110 also illustratively includes a threaded portion 124 on its upper portion 111. The threaded portion 124 is configured to be engaged with a cover such as a radome (not shown in FIG. 4), which is discussed in more detail below. A groove 128 is formed into the upper portion 111 at an end of the threaded portion 124 that is closer to the lower portion 113 of the body 112. A sealing element (not shown in FIG. 4) such as an o-ring can be placed onto the body 112 so that it is captured in the groove 128. Thus, when a cover is attached to the rotatable mount 110, the sealing element located in groove 128 can provide a seal to prevent moisture, dirt or other materials from entering into the channel 120 of the rotatable mount 110.

Figure 5:
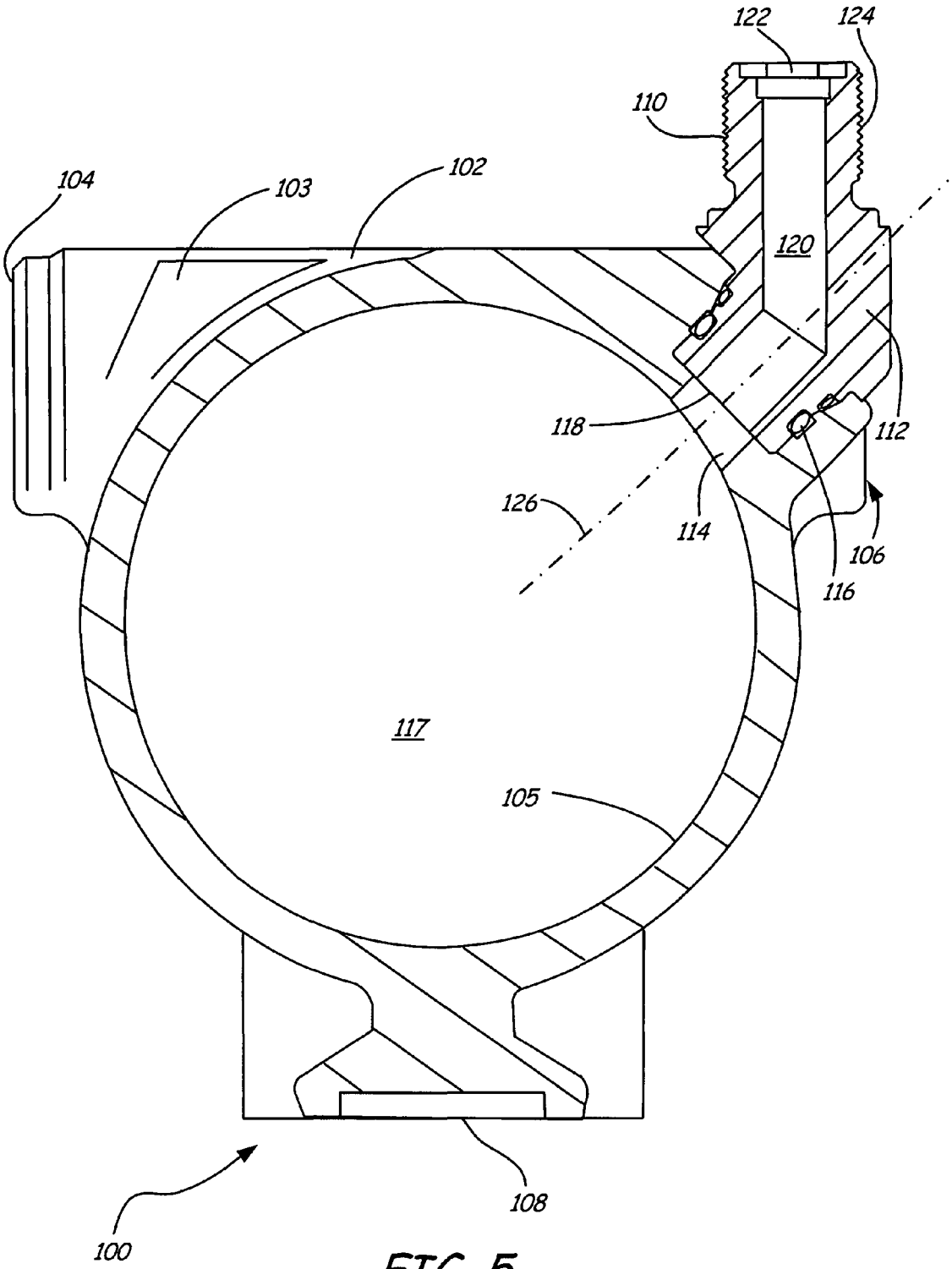
FIG. 5 is a cross sectional view of the field device of FIG. 3 taken along line 5-5.
Figure 6:
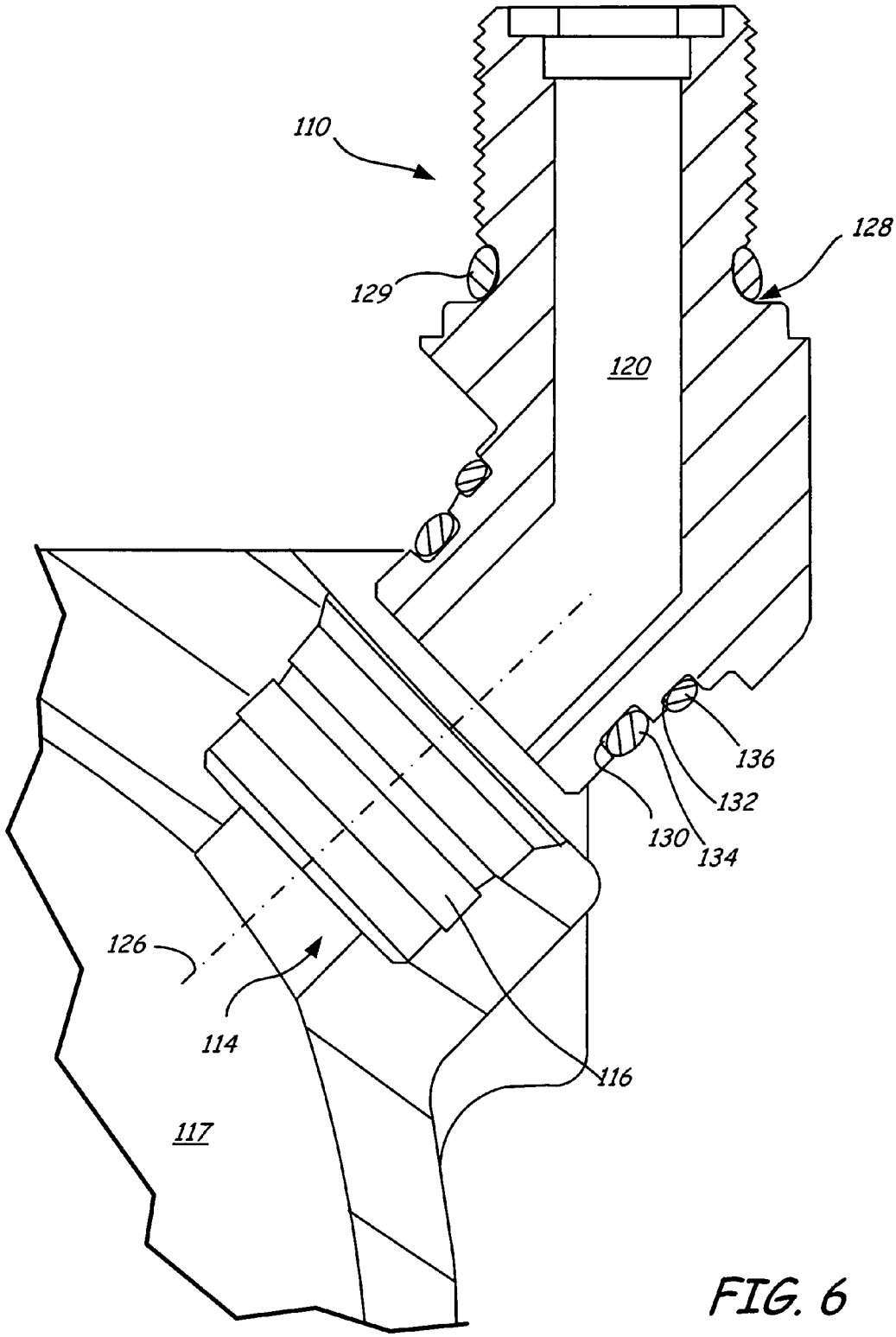
FIG. 6 is an enlarged portion of the cross sectional view of FIG. 4.

FIGS. 5 and 6 illustrate a cross sectional view of the field device 100 shown in FIG. 3. Rotatable mount 110 is shown positioned within an aperture 114 in FIG. 5 (and in an exploded view in FIG. 6) that extends from an outer surface 103 of housing 102 through housing 102 to provide access to a main cavity 117. Main cavity 117 is defined by an inner surface 105 of housing 102. The electrical components discussed above with respect to FIG. 2, including the power module 22, controller 24, transducer 26, and wireless communication device 28 are illustratively positioned within the main cavity 117. An antenna can be attached or positioned adjacent to the rotatable mount 110 (not shown in FIGS. 5 and 6). Connection can be made between the antenna and the electrical components such as by, for example, a coaxial cable that extends into the rotatable mount 110 from the main cavity 117 (not shown in FIGS. 5-6). The coaxial cable is connected to the antenna either within or external to the rotatable mount 110. Other connecting arrangements between the electrical components within main cavity 117 and the antenna can be employed without departing from the spirit and scope of the discussed embodiments.

Pursuant to one embodiment, a notch 116 is formed into a portion of the housing 102 that defines the aperture 114. The notch 116 illustratively extends around a perimeter of the aperture 114. The rotatable mount 110 is illustratively shown with sealing elements 134 and 136 positioned in grooves 130 and 132, respectively. In one illustrative embodiment, the sealing elements 134 and 136 are o-rings, although other devices can be used. For example, a retaining ring or clip can be inserted into groove 130 in lieu of, or in addition to, sealing element 134. The rotatable mount 110 is positioned within the aperture 114 so that the sealing element 134 (or the retaining ring or clip) engages both the groove 130 and the notch 116. Alternatively, or in addition, a set screw or one or more detents (not shown) can be employed to hold the mount 110 in a desired orientation.

The engagement of sealing element 134 with the groove 130 and the notch 116 provides a retaining force that keeps the rotatable mount 110 positioned within the aperture 114. In addition, the rotatable mount 110 is capable of rotating within the aperture 114 about axis 126. Because the channel 120 is angled, rotating the rotatable mount 110 about axis will change the orientation of an antenna that is attached to the rotatable mount 110. This allows the antenna to be positioned as desired. Further still, the engagement of the sealing element 134, the groove 130, and the notch 116 provide enough retention force to prevent the mount 110 from rotating unless an outside force is applied to the mount 110. The sealing element 136 provides protection from foreign matter entering the main cavity 117 of the housing 102 through the aperture 114 while allowing rotation of the mount 110.

Figure 7:
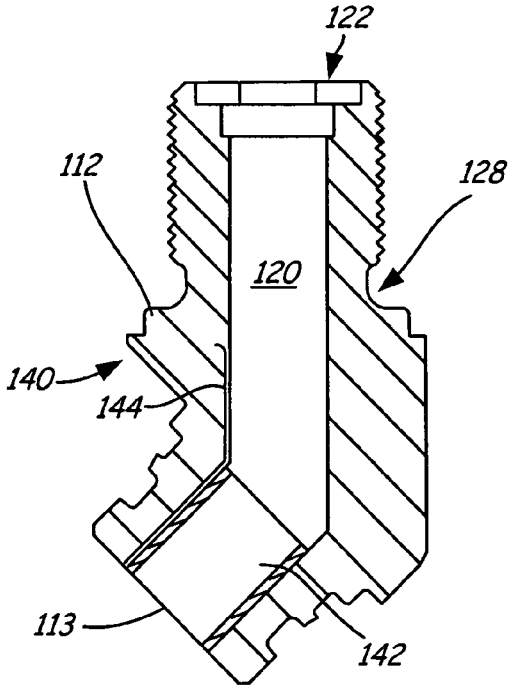
FIG. 7 is cross sectional view of an industrial antenna mount including a sleeve extending into a portion of the mount according to one illustrative embodiment.
Figure 8:
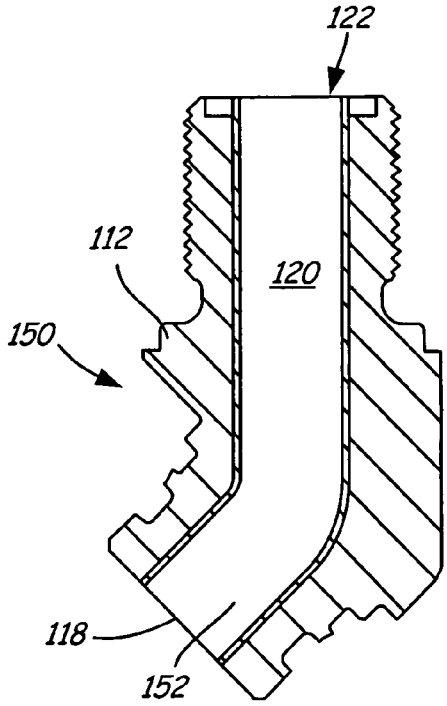
FIG. 8 is a cross sectional view of an industrial antenna mount including a sleeve extending from one end of the antenna mount to the other according to one illustrative embodiment.
Figure 9:
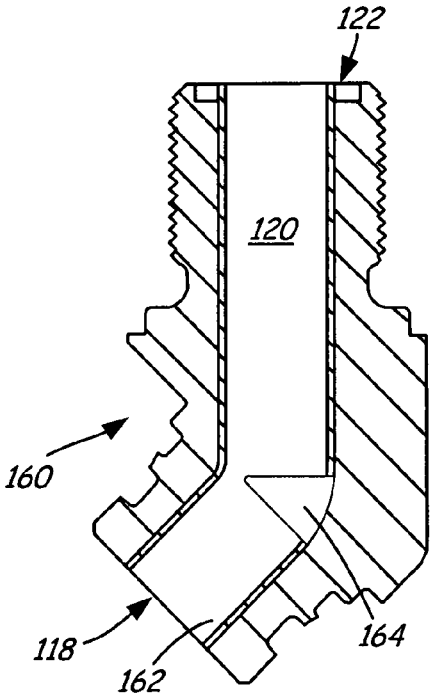
FIG. 9 is a cross sectional view of an industrial antenna mount having a sleeve extending through the mount with a notch formed therein according to one illustrative embodiment.

As discussed above, the body 112 of mount 110 is illustratively made of a polymeric material. Thus, the channel 120 is illustratively surrounded by such material. FIGS. 7-9 illustrate alternative embodiments of mount 110. Mount 140 includes a body 112 with a sleeve 142 that is illustratively inserted into, but not beyond a portion the channel 120 in the lower portion 113 of body 112. The sleeve 142 is illustratively made of a different material than that of body 112. As one illustrative example, the sleeve is made of aluminum, although a number of different materials may be used. Sleeve 142 is illustratively molded into the body 112, although alternatively, the sleeve 142 can be inserted into the body 112 after the body 112 has been molded. Sleeve 142, in one embodiment, includes a tab 144, which extends into the body 112 to provide a retention force to ensure that the sleeve 142 is retained within the body 110. The sleeve 142 provides additional strength to the mount 140. While sleeve 142 is shown as extending into the lower portion 113, it can extend into the body 112 any distance. As an example, mount 150 includes a sleeve 152 that extends through the entire channel 120 from aperture 118 to aperture 122. The mount 150 is formed from a material such as aluminum that provides strength to resist fatigue or impact-related failure that may be caused by a force applied to an antenna mounted to the mount 150.

Furthermore, while the sleeve 142, when inserted or positioned within the rotatable mount 110 is shown as defining the channel 120, alternatively a sleeve or other reinforcing elements can be molded into or attached to the rotatable mount in other locations. For example, structural reinforcements can be contained within the polymeric material that forms the rotatable mount. In another alternative, the reinforcement elements can define part or the entire outer surface 103 of body 112.

Referring to FIG. 9, mount 160 includes a sleeve 162 that also extends through the channel 120 from the aperture 118 to the aperture 122. However, sleeve 162 also has a notch 164 formed into it. Sleeve 162, as discussed above, can be formed from a material such as aluminum. The sleeve 142 is illustratively formed from a straight tube. The process of bending a straight tube to such an angle can be difficult. By forming a relief such as notch 164, the sleeve 162 is advantageously more easily manufactured.

Figure 10:
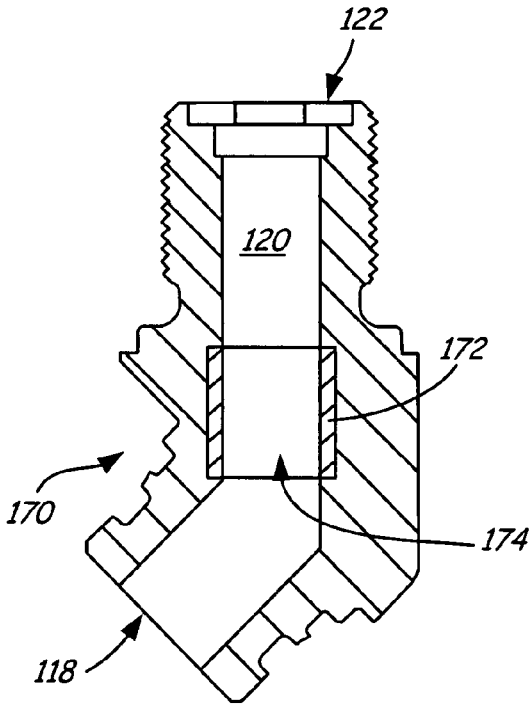
FIG. 10 is a cross sectional view of an industrial antenna mount having an embedded ferrite element formed therein according to one illustrative embodiment.

FIG. 10 illustrates a mount 170 according to yet another embodiment. Mount 170 includes a ferrite element 172 that is molded into the body 112 of mount 170. Ferrite element 172 is illustratively a cylindrically shaped member with an aperture 174 formed through its center. The ferrite element 172 advantageously provides filtering of electrical interference that may be conducted or inducted onto, for example, a cable that extends into the channel 120. The ferrite element 172 can be of any suitable size. In addition, the ferrite element 172 can alternatively be included with other mounts such as, for example, mount 140. While the ferrite element is shown as being molded into the body 102 of mount 140, the ferrite element can be inserted into the channel 120 and secured therein through the use of a variety of different structures or methods.

Figure 11A:
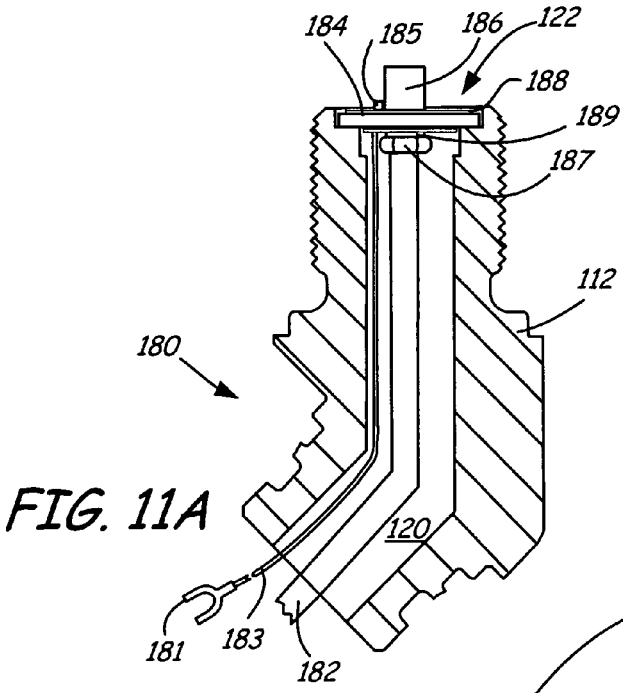
FIG. 11A is a cross sectional view of an industrial antenna mount having an attachment for a base of an antenna integrated into the mount according to one illustrative embodiment.

FIG. 11A illustrates a mount 180 according to yet another embodiment. Mount 180 includes a body 112. As discussed above, body 112 can be formed from a number of different materials. In this particular embodiment, body 112 is illustratively formed from a non-conductive material. Mount 180 includes a circuit board or circuit card assembly 184 that is positioned within the aperture 122 of the body 112. The circuit board 184 has a connector 186 attached to it for engaging an antenna. In one illustrative embodiment, the connector 186 is a subminiature version A (SMA) connector.

The circuit board 184 illustratively includes a layer of conductive material 188, which is formed on the circuit board 184. The conductive material 188 can be located on either or both major surfaces of the circuit board 184 as is shown in FIG. 11A. The circuit board 184 can include filtering circuitry such as filtering component 185 to provide noise reduction on the signal received from or provided to the antenna. A cable 182 having a connecting device 187 is illustratively attached to a' connector 189 to provide a connection between the antenna and electronics located within the main cavity (117 shown in FIG. 5).

In one illustrative embodiment, a cable 183 is attached to the conductive layer 188 and includes a connector 181, which is configured to be attached to the housing 102. Cable 183 can be of any length so as to be mounted to the housing 102 at an appropriate location. Cable 183 is illustrated as being broken to indicate that the length of cable 183 can be variable to allow the cable 183 to be attached to the housing 102 at any location. The layer of conductive material 188 is thereby in electrical communication with the housing 102 when the cable 183 is attached to the housing 102. The filtering components 185 are illustratively positioned between the conductive layer 188 and any conductor attached to the antenna. The signal from the antenna is thus filtered to reduce electrical noise that may be induced onto the antenna.

Figure 11C:
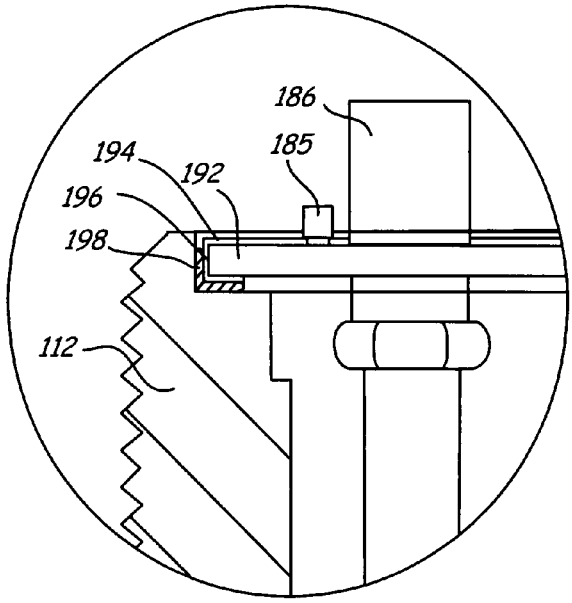
FIG. 11C is an enlarged portion of the industrial antenna mount of FIG. 11B detailing a connection between the attachment and mount according to one illustrative embodiment.
Figure 11B:
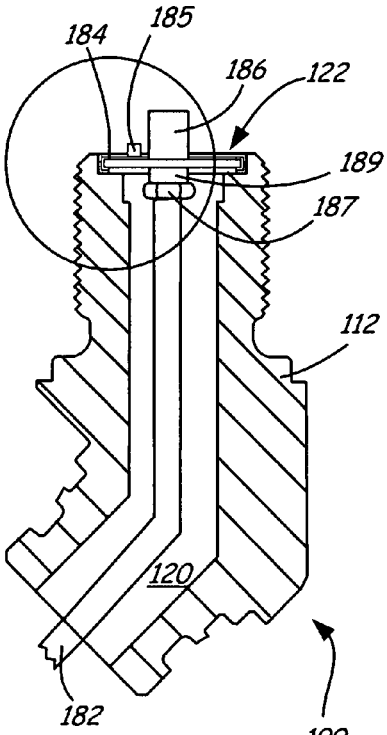
FIG. 11B is a cross sectional view of an industrial antenna mount having an attachment for a base of an antenna with a conductive portion of the attachment in electrical communication with the mount according to one illustrative embodiment.

FIGS. 11B-C illustrate a mount 190 according to another illustrative embodiment. Mount 190 includes a body 112 that is formed from a conductive material. Mount 190 further includes a circuit board or circuit card assembly 192 that is positioned within the aperture 122 of the body 112. Circuit card assembly 192 has a conductive layer 194 of material that extends around an edge 196 of the circuit card assembly 192. The circuit card assembly 192 is illustratively attached to the body 112 of mount 190 such as by a solder joint 198 formed between the conductive layer 194 and the body 112. The solder joint 198 provides a connection between the body 112 and the circuit card assembly 192. In addition, the solder joint 198 provides a conductive path between the conductive layer 192 and the body 112.

As discussed above, the body 112 in the illustrative embodiment is formed from a conductive material. Therefore, when the body 112 is attached to the housing 102, the conductive layer 194 is in electrical communication with the housing 102. Filtering component 185, which is positioned between the connector 186 and the conductive layer 192 provides filtering to reduce electrical noise that may be induced onto the antenna.

Figure 12:
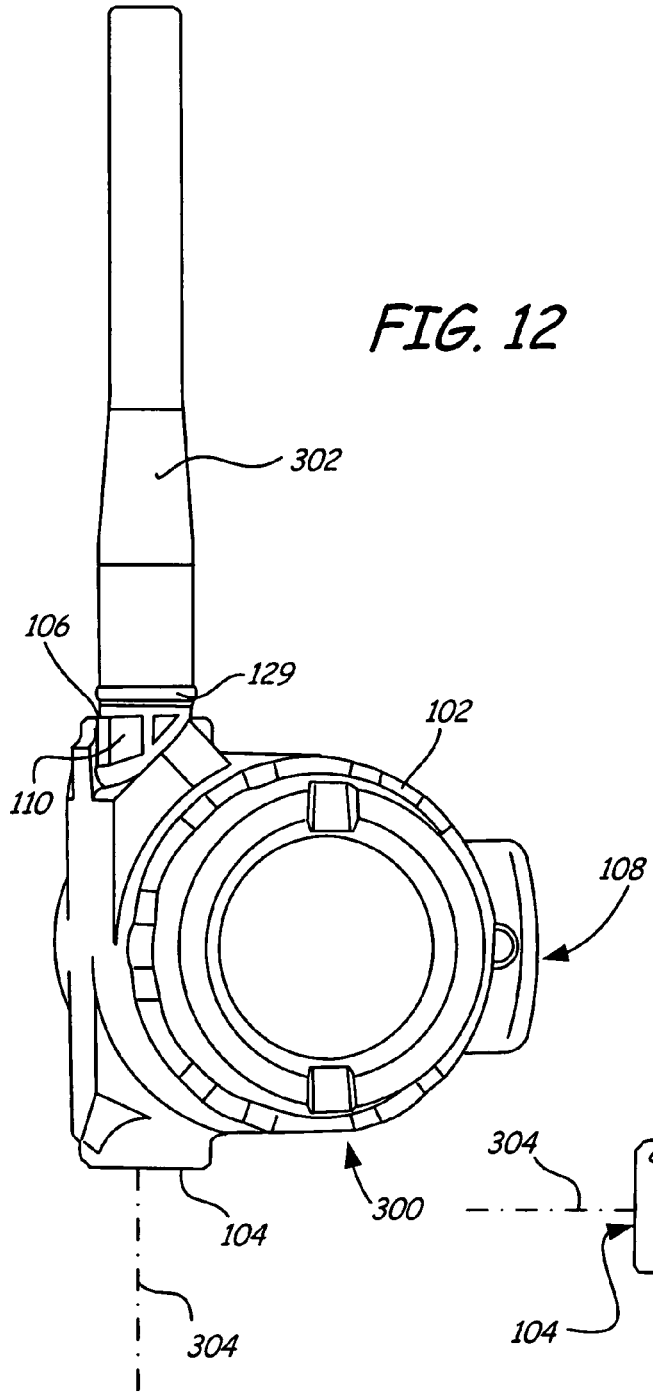
FIG. 12 is a perspective view of the field device of FIG. 3 with a radome attached to the antenna mount in one orientation according to one illustrative embodiment.
Figure 13:
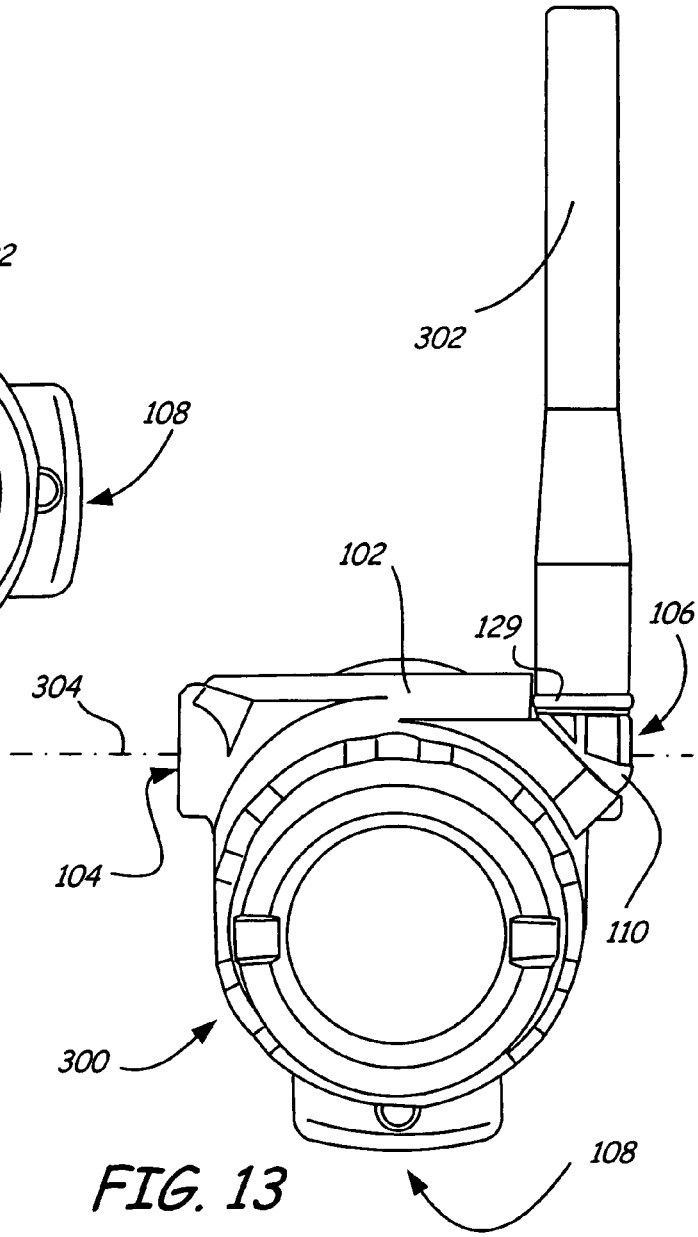
FIG. 13 is a perspective view of the field device of FIG. 12 with the antenna mount in another orientation.

FIGS. 12 and 13 illustrate a field device 300 in accordance with one illustrative embodiment. The field device 300 includes a housing 102 with a rotatable antenna mount 110 attached to the housing 102. A radome 302 is attached to the mount 110. Radome 302 is, in one illustrative embodiment, attached to the mount 110 by engaging the threads (124, shown in FIG. 4) located on the mount 110. The rotatable mount 110 is shown in FIG. 12 as being oriented so that the radome 302 extends along an axis 304 that runs through the apertures 104 and 106. In FIG. 13, the rotatable mount is oriented so that the radome 302 extends generally normal to the axis 304. It is to be understood that the mount 110 is not limited to these two positions, but can be positioned in any number of positions as needed to ensure that the antenna is properly oriented depending on the orientation of the installed field device 300. The radome 302 provides environmental protection for the antenna (not shown) located within the radome 302. A sealing element 129 is positioned around groove 128 (shown in FIG. 5) to provide additional sealing protection.

Figure 14:
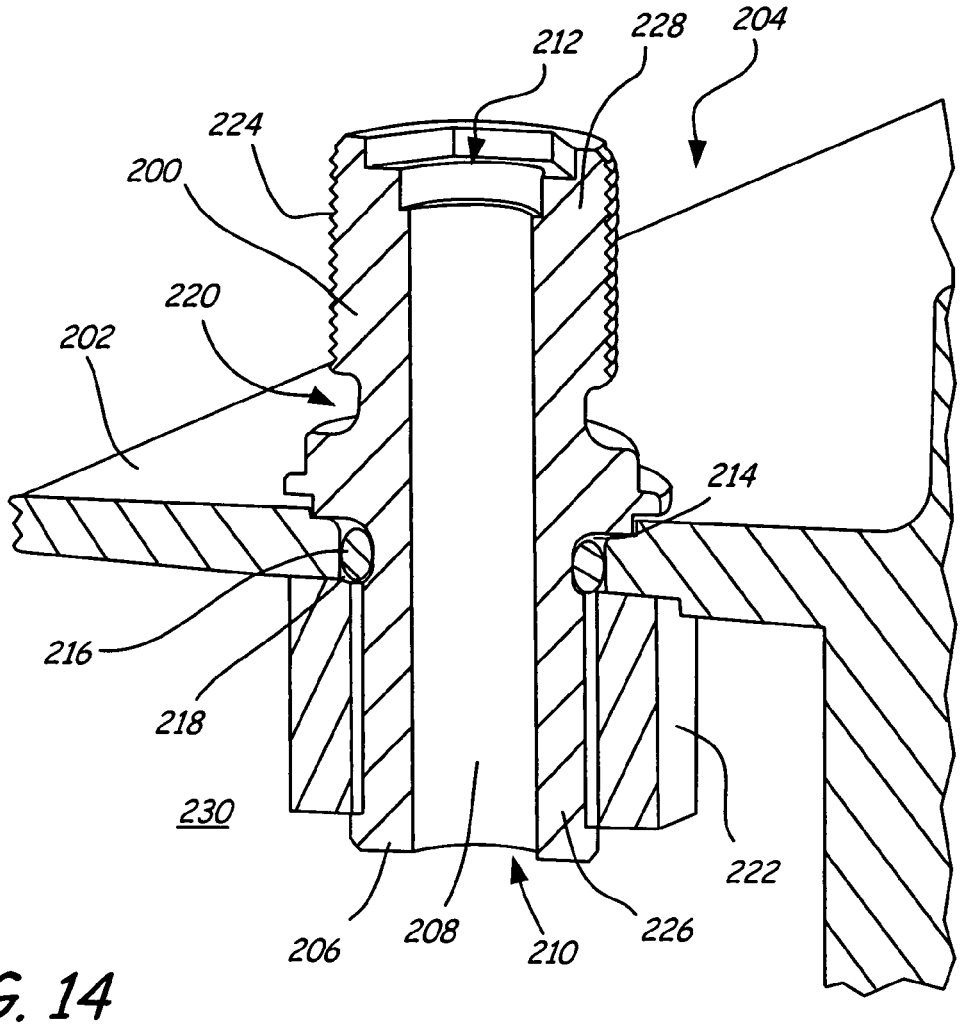
FIG. 14 is a perspective view of an antenna mount having a generally straight configuration according to one illustrative embodiment.

FIG. 14 illustrates an antenna mount 200 according to another illustrative embodiment. Antenna mount 200 is shown in cross section and is, in one illustrative embodiment, generally symmetrical about the axis on which the cross section was taken. Antenna mount 200 is attached to a housing 202 of a field device 204. Antenna mount 200 includes a body 206, with a channel 208 that extends from a first end 210 to a second end 212 of the body 206. Antenna mount 200 is illustratively made of the same types of materials as previously discussed embodiments. In addition, although not shown in FIG. 14, mount 200 can alternatively include a sleeve of the type shown in FIGS. 7-9, a ferrite element of the type shown in FIG. 10, and/or a connector of the type shown in FIG. 11.

The antenna mount 200 extends into an aperture 218 formed into the housing 202. The mount includes a body 206 that illustratively has a channel 208 extending from a first aperture 210 to a second aperture 212. The channel 208 is configured to accept a cable or other device to provide a connection between electrical components (not shown in FIG. 14) and an antenna (also not shown in FIG. 14) that is connected to antenna mount 200. The antenna mount 200 includes a pair of grooves 214 and 220. The groove 214 is configured to accept a sealing element 216, which in one illustrative embodiment is an o-ring, to engage both the portion of the mount 200 that defines the groove 214 and the portion of the housing that defines a perimeter of the aperture 218. In addition, a collar 222 is configured to engage a lower portion 226 of the body 206. The collar 222 engages the lower portion 226 and the housing 202 to provide a retaining force to maintain the antenna mount 200 in engagement with the housing 202. Body 206 also includes threads 224 located on an upper portion 228 of the body 206. A radome (not shown in FIG. 14) or other device can be attached to the antenna mount 200 at the threads 224 to provide environmental protection for the antenna and any components located within a main cavity 230 in the housing 202.

The antenna mount 200, as illustrated in FIG. 14, is capable of being rotated with respect to the housing 202. However, the channel 208, unlike the channel 120 in previous embodiments is generally linear in its shape from the first aperture 210 to the second aperture 212 and is generally aligned with an axis about which the antenna mount is capable of rotating. Thus, rotating the antenna mount 200 generally does not change the orientation of the antenna with respect to the housing 202.

Figure 15:
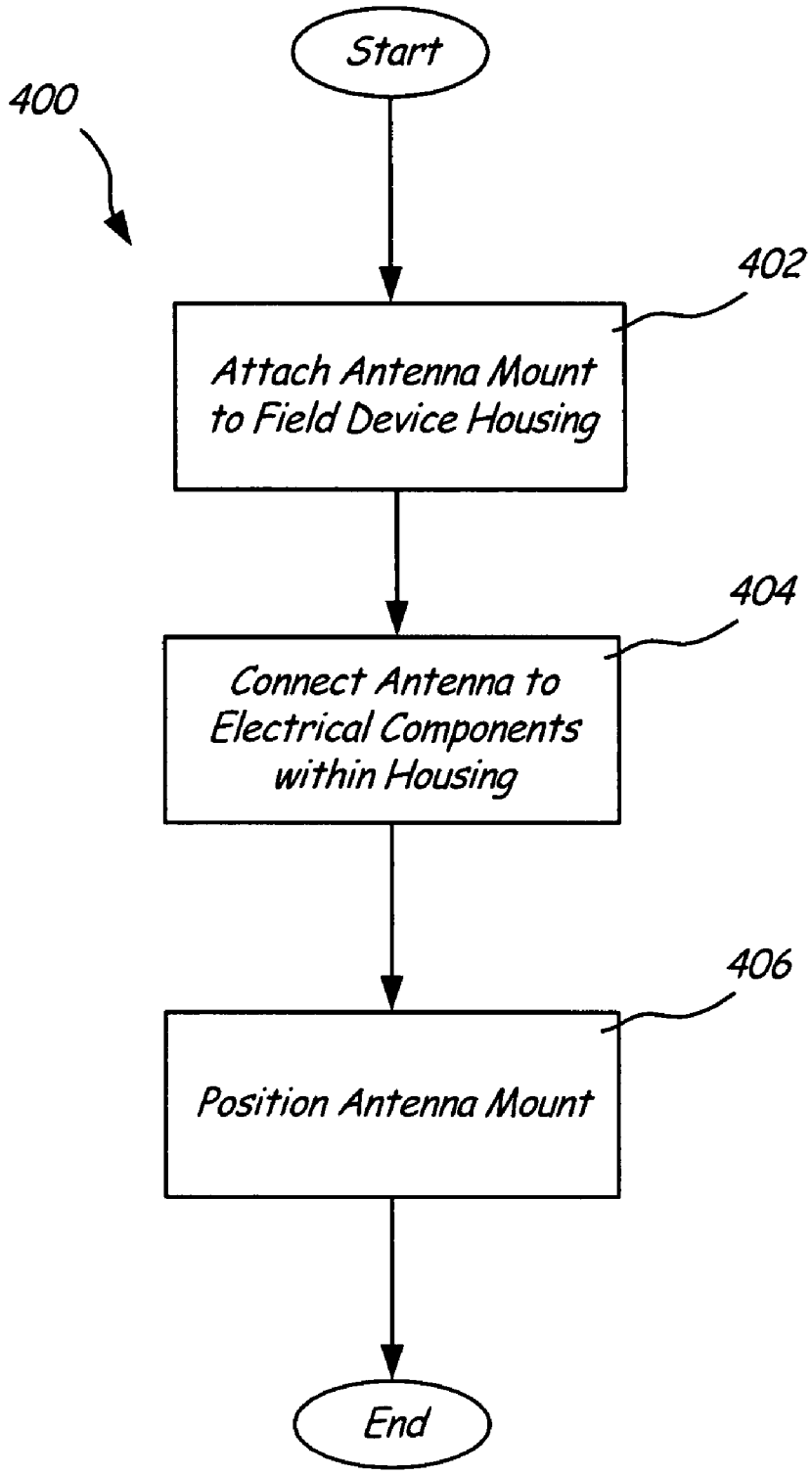
FIG. 15 is a flowchart depicting a method of positioning an antenna on a wireless field device according to one illustrative embodiment.

FIG. 15 is a flowchart illustrating a method 400 of use for field device 300 (shown in FIGS. 12-13) having an antenna mount 110. In step 402, the antenna mount 110 is attached to the housing 102. An antenna (not shown in FIGS. 12-13) is connected with electronics located within the housing 102, as shown by step 404. The antenna can be covered with a cover such as the radome 302. The antenna can be attached to the rotating mount, positioned within the rotatable mount 110, or positioned externally with respect to the rotatable mount 110. For example, the antenna can be attached to the radome. The antenna is then placed in a desired orientation by rotating the rotatable mount 110 as is shown in block 406. The rotatable mount 110 can be rotated into any of a number of positions. In one illustrative embodiment, the rotatable mount 110 has an infinite number of positions over the range of its acceptable rotation. The range of rotation can be unlimited or alternatively may be limited to a defined total angle of rotation.

The embodiments discussed above provide important advantages. The mounts discussed above provide an easy way to rotate an antenna into a proper orientation as is determined by the orientation in which a particular field device is installed. The mounts also provide sealing for the internal cavity of the field device. In addition, some of the embodiments provide reinforcement sleeves to provide additional strength as needed. Antennas can be positioned within the cover or directly attached to the mount.

Although the present discussion has been focused on illustrative embodiments, workers skilled in the art will recognize that changes may be made in form and detail without departing from the spirit and scope of the discussion.

What is claimed is:

1. A field device, comprising:

a housing having an outer surface, an inner surface surrounding a main cavity, and an aperture extending from the main cavity to the outer surface;

an electrical component located within the main cavity of the housing;

an antenna in electrical communication with the electrical component;

a rotatable mount attached to the housing and having a channel extending from a first end to a second end;

a cable electrically connected to the electrical component and the antenna; and wherein the cable extends through at least a portion of the channel;

wherein at least a portion of the rotatable mount comprises a polymer material, wherein the rotatable mount further comprising, a generally hollow sleeve formed from a conductive material, and the sleeve is positioned within and attached to at least a portion to the channel.

2. The field device of claim 1, wherein the sleeve extends from the first end to the second of the channel.

3. The field device of claim 1, wherein the sleeve has a notch formed into it between the first end and the second end.

4. The field device of claim 1, wherein the rotatable mount has a first portion and second portion wherein the first portion is configured to be inserted into the aperture.

5. The field device of claim 4, wherein the first portion is positioned at an angle with respect to the second portion.

6. The field device of claim 5, wherein the first portion is positioned at about a 45-degree angle with respect to the second portion.

7. The field device of claim 4, and further comprising:

a sealing element attached to the first portion of the rotatable mount; and wherein the housing includes a feature adjacent the aperture and wherein the sealing element is positioned to engage the feature when the rotatable mount is attached to the housing.

8. The field device of claim 1, and further comprising:

a circuit board positioned at least partially within the rotatable mount;

a connector attached to the circuit board; and wherein the antenna is coupled to the connector.

9. The field device of claim 8, and further comprising:

a filtering component positioned on the circuit board.

10. The field device of claim 1 and further comprising:

a ferrite element coupled to the rotatable mount and positioned to receive and surround a portion of the cable.

11. The field device of claim 1 and further comprising:

a cover attached to the rotatable mount wherein the at least a portion of the antenna is positioned within the cover.

12. An antenna mount for a field hardened industrial device, comprising:

a first portion having an outer surface and an inner surface defining a first segment of an internal channel that extends from a first end to an aperture at the outer surface of a second end;

a second portion having an outer surface and an inner surface defining a second segment of the internal channel in communication with the first segment that extends from a first end to an aperture at the outer surface of a second end;

wherein the first and second portions are attached to each other along a generally planar attachment surface at their first ends and wherein the attachment surface is not perpendicular to the any of the outer surface at the second ends of the first and second portions.

13. The antenna mount of claim 12, wherein the first and second portions are first and second portions extend away from each other at the generally planar attachment surface at about a 45-degree angle.

14. The antenna mount of claim 12 and further comprising:

a generally hollow sleeve attached to and positioned within the second segment of the internal channel.

15. The antenna mount of claim 14, wherein at least a portion of the hollow sleeve extends into the first segment of the internal channel.

16. A field device, comprising:

a housing having an outer surface, an inner surface surrounding a main cavity, and an aperture extending from the main cavity to the outer surface;

an electrical component located within the main cavity of the housing;

an antenna in electrical communication with the electrical component;

a rotatable mount attached to the housing and having a channel extending from a first end to a second end;

a cable electrically connected to the electrical component and the antenna, wherein the cable extends through at least a portion of the channel; and a ferrite element coupled to the rotatable mount and positioned to receive and surround a portion of the cable.

17. A field device, comprising:

a housing having an outer surface, an inner surface surrounding a main cavity, and an aperture extending from the main cavity to the outer surface;

an electrical component located within the main cavity of the housing;

an antenna in electrical communication with the electrical component;

a rotatable mount attached to the housing and having a channel extending from a first end to a second end; and a cable electrically connected to the electrical component and the antenna;

wherein the cable extends through at least a portion of the channel;

wherein the rotatable mount has a first portion and second portion, the first portion is configured to be inserted into the aperture, the first portion is positioned at an angle with respect to the second portion, the first portion is positioned at about a 45-degree angle with respect to the second portion.

* * * * *